US007461417B2

(12) United States Patent
Godbersen

(10) Patent No.: US 7,461,417 B2
(45) Date of Patent: Dec. 9, 2008

(54) APPARATUS FOR USE WITH SPAS

(75) Inventor: Bruce L. Godbersen, Ida Grove, IA (US)

(73) Assignee: Byron Originals, Inc., Ida Grove, IA (US)

( * ) Notice: Subject to any disclaimer, the term of this patent is extended or adjusted under 35 U.S.C. 154(b) by 0 days.

(21) Appl. No.: 11/684,776

(22) Filed: Mar. 12, 2007

(65) Prior Publication Data

US 2008/0222791 A1 Sep. 18, 2008

(51) Int. Cl.
*A47K 3/12* (2006.01)

(52) U.S. Cl. ..... 4/541.1; 4/559; 4/576.1; 248/125.7; 248/418; 248/425

(58) Field of Classification Search ..... 4/559, 4/576.1, 541.1–541.6, 571.1, 557.1, 661, 4/604, 496; 211/85.4, 88.04, 119.009–119.011, 211/131.1; 248/125.7, 131, 177.1, 178.1, 248/186.1, 415, 418, 425
See application file for complete search history.

(56) References Cited

U.S. PATENT DOCUMENTS 488,608 A * 12/1892 Hotchkiss ..... 248/214
989,773 A * 4/1911 Flockhart ..... 211/119.011
2,174,650 A * 10/1939 Bentz ..... 211/119.011
2,664,142 A * 12/1953 Scheuerman et al. ..... 4/578.1 X
2,981,959 A * 5/1961 Burnham ..... 5/503.1
3,604,019 A * 9/1971 Garner ..... 4/576.1
5,048,131 A * 9/1991 Stephen ..... 4/559
5,974,600 A * 11/1999 Pucci et al. ..... 4/498
6,039,293 A * 3/2000 Minet ..... 248/125.8
6,565,060 B2 * 5/2003 Li et al. ..... 248/418 X

* cited by examiner

*Primary Examiner*—Robert M Fetsuga
(74) *Attorney, Agent, or Firm*—Sturm & Fix LLP

(57) ABSTRACT

An apparatus having a tray, a towel rack and a handrail is provided for use with a spa of a type having a bottom with sidewalls extending upwardly from the bottom to form an enclosure for holding water. A base member is disposed on a horizontal floor below and adjacent to the sidewalls of the spa. A vertically disposed post member operatively attached to the base member and a handrail operatively attached to a top portion of the post member, the handrail being transversely disposed with respect to the post member. A horizontally disposed tray is pivotally attached to the post and a towel bar is attached to the post. Structures are provided for securing the preferred embodiment of the invention to a spa.

16 Claims, 3 Drawing Sheets

Fig. 3
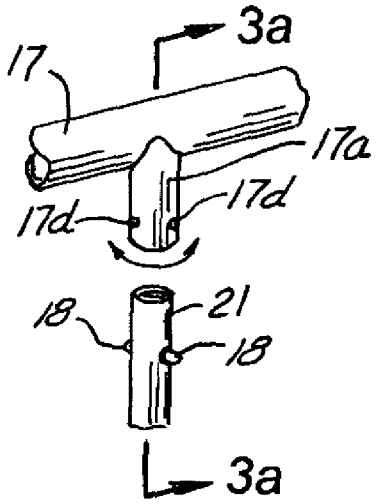
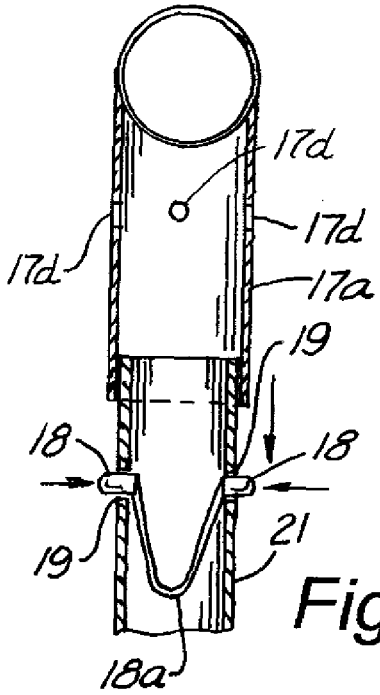
Fig. 3a
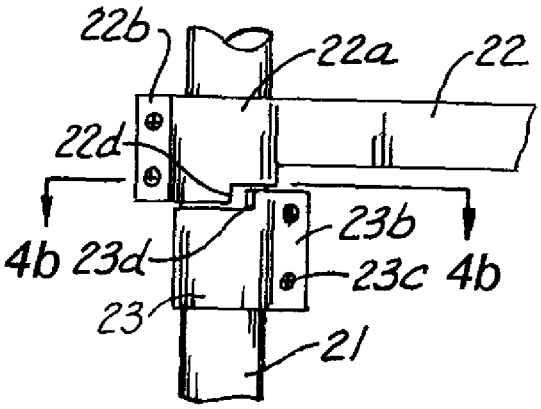
Fig. 4
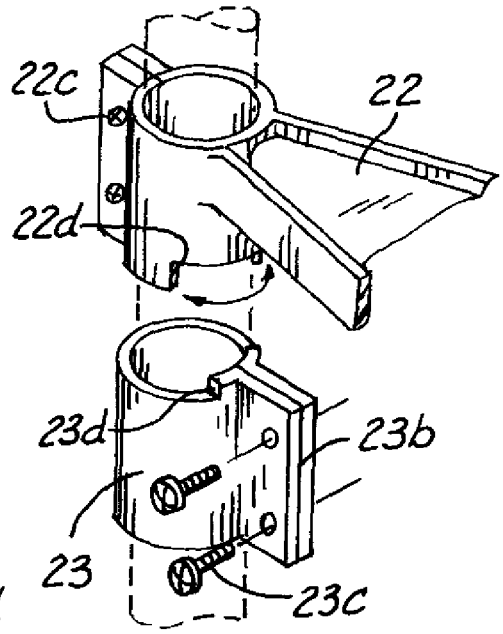
Fig. 4a
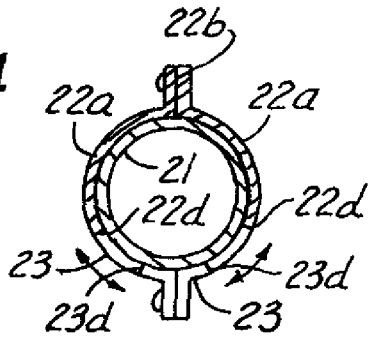
Fig. 4b Fig. 5
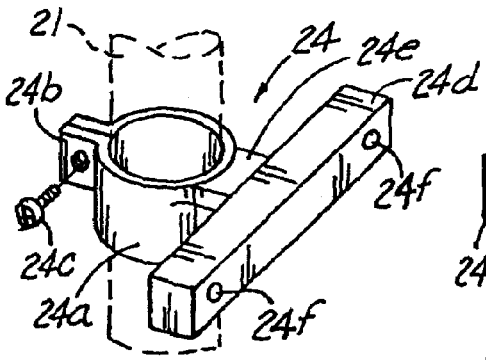
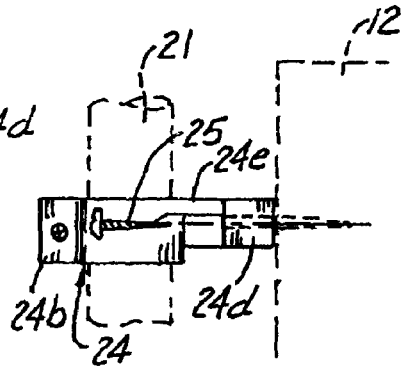
Fig. 5a
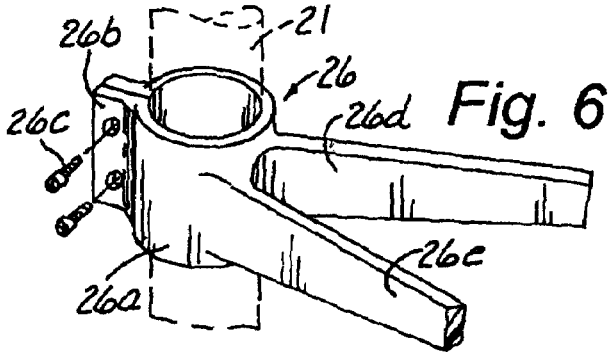
Fig. 6
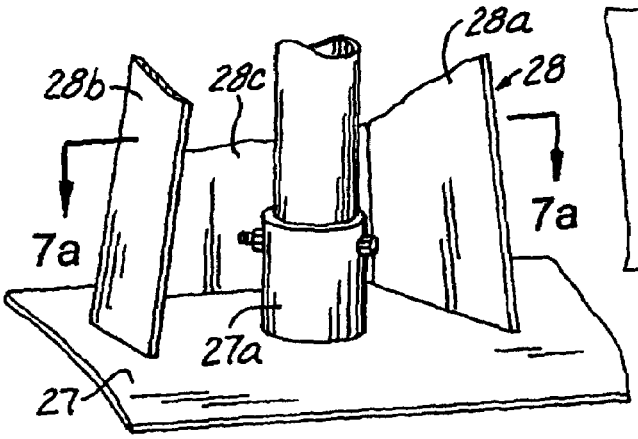
Fig. 7
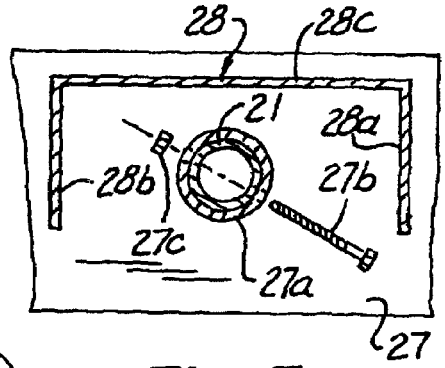
Fig. 7a

APPARATUS FOR USE WITH SPAS

FIELD OF THE INVENTION

The present invention relates generally to spas, and more specifically to a combination handrail, tray and towel rack apparatus for use with a spa or hot tub.

BACKGROUND OF THE INVENTION

Spas and hot tubs are in their most basic form a container of water that has heated water circulated into and out from such container. Some spas or hot tubs are recessed into the ground or into a deck raised from the ground. However, there are many spas or hot tubs that are added after the first construction of a building, such as a house, hotel, motel or the like, are simply placed on top of a floor, concrete pad, patio or deck adjacent to such building. These later added spas, not installed when the building was first constructed, will be referred to as "aftermarket spas". Spas can be placed inside or outside of a building. Hereinafter, "spa" will be used generically to include all types of containers raised off of a floor or other supporting surface that contain water for the purpose of permitting people to enter from the top thereof for recreational purposes and can include above ground swimming pools.

For these aftermarket spas which are placed on a floor or other surface, typically need some kind of steps placed adjacent to them so people can easily enter the spa. Of course those using the spa will have things they bring to the spa which they want to have accessible, but which they do not wish to get wet such a towels, beverages in glasses or containers, watches, articles of clothing, etc. Of course some things like shoes can be left on the floor adjacent the spa, but other things need to be kept off of the floor and closer to the person using the spa. So there exists a need to solve this problem.

SUMMARY OF THE INVENTION

The present invention relates to an apparatus for use with a spa of a type having a bottom with sidewalls extending upwardly from the bottom to form an enclosure for holding water. A base member is disposed on a horizontal floor below and adjacent to the sidewalls of the spa. A vertically disposed post member operatively attached to the base member and a handrail operatively attached to a top portion of the post member, the handrail being transversely disposed with respect to the post member. A horizontally disposed tray is pivotally attached to the post and a towel bar is attached to the post.

BRIEF DESCRIPTION OF THE DRAWINGS

FIG. 3 is a perspective detail view of a top portion of a vertical post, showing how a handrail is attached thereto at the portion show by the labeled FIG. 3 circled on FIG. 2;

FIG. 3*a* is a cross sectional view taken along line 3*a*-3*a* of FIG. 3 showing how buttons are biased outwardly through openings in the top of the post and how the buttons can be pushed in to allow the handrail to telescope over the top of the post and buttons and how the buttons can then be release to hold the handrail fixed with respect to the post;

FIG. 4 is an enlarged side view of that part of a tray at the portion shown by the labeled FIG. 4 circled on FIG. 2, showing how it attaches to the post, shown in dashed lines, and the details of a stop structure to control and limit the normal rotation of the tray with respect to the post;

FIG. 4*a* is an enlarged partial perspective exploded view of that part of the tray that is attached around the post, shown in dashed lines, and how that part of the tray cooperates with a collar below it with a stop on it to limit the rotation of the tray in two rotary directions;

FIG. 4*b* is a top view of FIG. 4 showing how the tray can rotate to some extent with respect to a collar on the post whereby both parts operate as a stop to limit rotation in two rotary directions;

FIG. 5 is an enlarged perspective view at the portion shown by the labeled FIG. 5*a* circled on FIG. 2, of a bracket disposed around the post, shown in dashed lines, the bracket having a fastener to hold the bracket tight with respect to the post and two openings for receiving threaded fasteners, not shown, to attach to a sidewall of the spa;

FIG. 6 is an enlarged perspective view at the portion shown by the labeled FIG. 6 circled on FIG. 2, of a portion of a towel rack disposed around the post, shown in dashed lines, with fasteners shown exploded away for tightening the towel rack to the post to a position wherein it is tight enough to prevent the towel rack from sliding down the post;

FIG. 7 is an enlarged perspective view at the portion shown by the labeled FIG. 7 circled on FIG. 2, of a portion of the structure which connects the post to the base and of a structure surrounding three sides of such structure and further adds to the structural integrity of the attachment of the apparatus to the spa; and FIG. 7*a* is a cross sectional view taken along line 7*a*-7*a* of FIG. 7.

DETAILED DESCRIPTION OF THE PREFERRED EMBODIMENTS

Figure 1:
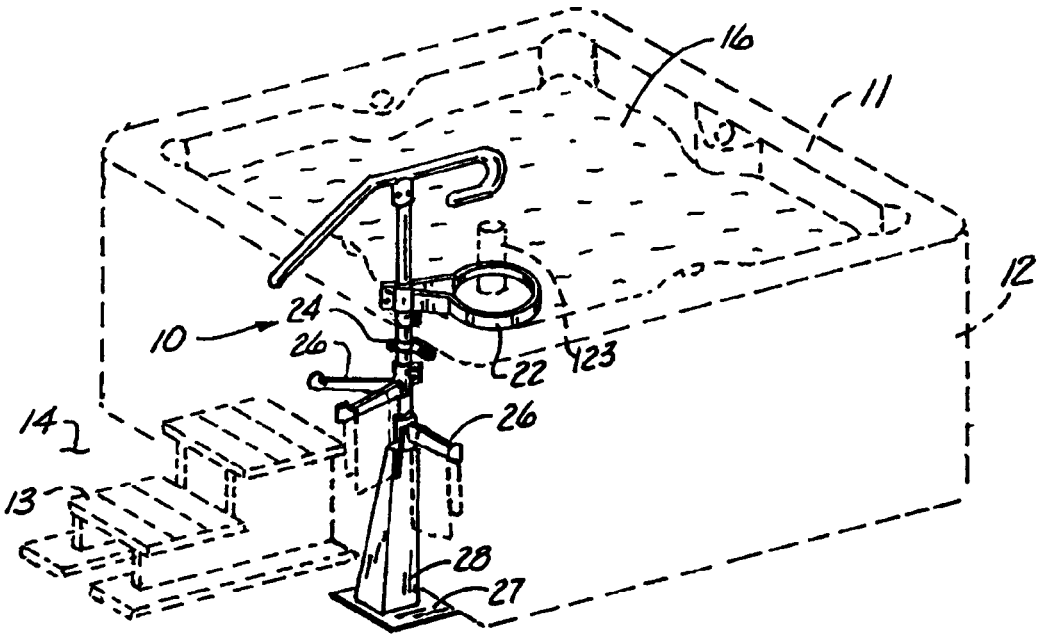
FIG. 1 is a perspective view of a preferred embodiment of the present invention in use attached to a spa, shown in dashed lines.
Figure 2:
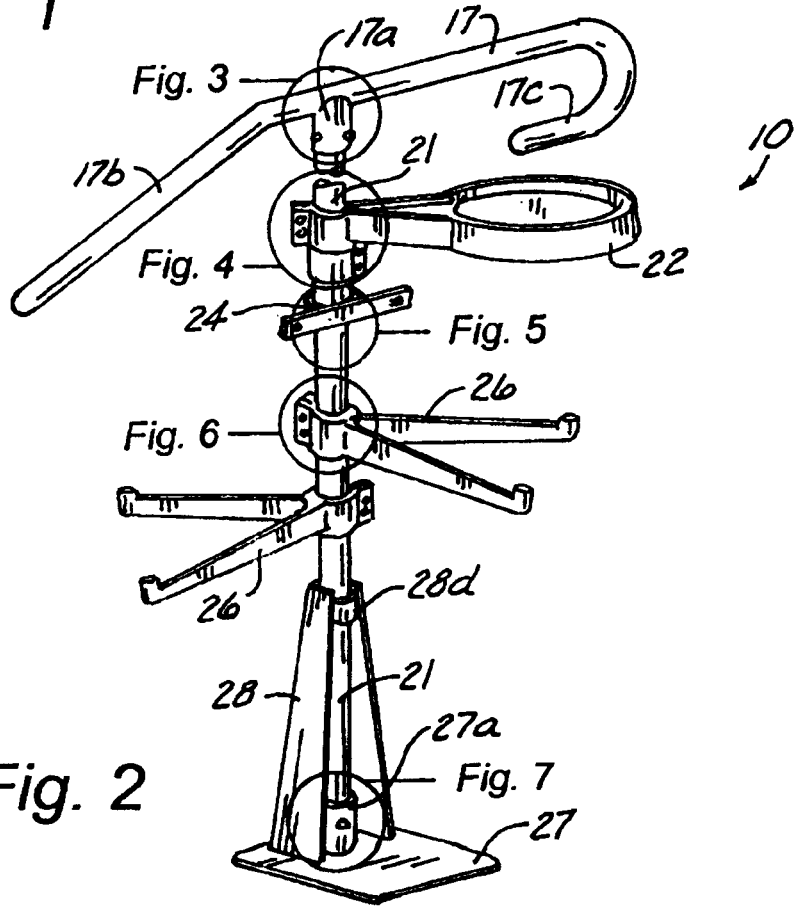
FIG. 2 is an enlarged perspective view of the present invention from a different angle than that shown in FIG. 1.

Referring now to the drawings wherein like reference numerals designate identical or similar parts throughout the several views, a preferred embodiment 10 of the present invention is illustrated in FIGS. 1 and 2 attached to a spa 11 with sidewalls 12 and steps 13 leading from a floor 14 to the inside of the spa containing water 16.

In the preferred embodiment 10 shown, it is assumed that more right handed people than left handed people will be using the embodiment 10. Of course it could be disposed on the left side of the steps 13 if desired, or an embodiment 10 of the present invention could be placed on the left side of the steps in addition to the placement of the one 10 shown in FIG. 1.

The handrail 17 can be of the configuration shown with portions 17*a*, 17*b* and 17*c* and attached as shown in FIG. 3 and 3*a*, showing how buttons 18 are biased outwardly by a resilient connecting member 18*a* through openings 19 in the top of the post 21 and how the buttons 18 can be pushed in to allow the handrail 17 to telescope over the top of the post 21 and buttons 18 and how the buttons 18 can then be release to hold the handrail 17 fixed with respect to the post 21. The handrail 17 has four holes 17*d*, in pairs across from each other, as shown in FIG. 3*a* so that it can pivot and lock at 90 degree intervals by means of the snap lock buttons 18. In a preferred embodiment the handrail 17 is powder coated steel.

FIG. 1 shows a tray 22 attached high enough so that it can be disposed above the sidewalls 12 of the spa 11. This allows a user to place objects on the tray 22 while in the spa 11, such as the beverage can or glass 123 shown in FIG. 1.

FIG. 4 is an enlarged side view of that part of a tray 22, sometimes referred to as the serving tray 22, at the portion shown by the labeled FIG. 4 circled on FIG. 2, showing how the tray portion 22*a* attaches to the post 21, shown in dashed lines, and the details of a stop structure 22*d* to control and limit the normal rotation of the tray with respect to the post 21 in conjunction with limiting collar 23 which is disposed around the post 21 and is adjustably affixed thereto by flanges 23*b* that are squeezed together by threaded fasteners 23*c*. In that way, the stop flanges 23*d* work with stops 22*d* on the tray 22 to limit rotation of the tray. By choosing the orientation of affixing the member 23 on the post 21, one can choose where one wishes to have the tray 22 be located during use, which is usually going to be in more or less the position shown in FIG. 1.

FIG. 4*b* is a top view of FIG. 4 showing how the tray 22 can rotate to some extent with respect to a collar 23 on the post 21 whereby both parts 22*d* and 23*d* operate as a stop to limit the amount of rotation in two rotary directions.

FIG. 5 is an enlarged perspective view at the portion shown by the labeled FIG. 5 circled on FIG. 2, of a bracket disposed around the post, shown in dashed lines, the bracket 24 having a clamp portion 24*a* extending around the post 21 and a fastener 24*c* to hold the bracket tight with respect to the post 21. Two openings 24*f* in part 24*d* are provided for receiving threaded fasteners 25 in FIG. 5*a* to attach the bracket 24 to a sidewall 12 of the spa 11. Connecting part 24*e* is what connects the part 24*a* to the part 24*d*.

FIG. 6 is an enlarged perspective view at the portion shown by the labeled FIG. 6 circled on FIG. 2, of a portion of a towel rack disposed around the post 21, shown in dashed lines, with fasteners 26*c* shown exploded away for tightening flanges 26*b* of the towel rack 26 to the post 21 to a position wherein the flanges 26*b* and part 26*a* are tight enough to frictionally engage the post 21 to prevent the towel rack from sliding down the post 21. If the amount of tightening of the flanges 26*b* is done in a preferred fashion the screws 26*c* are only tightened enough to provide a slight drag to rotational movement and with this comes adjustability. (This same procedure can be used with respect to the connection of the tray 22 to the post 21 too, if desired.) However, if the user wants to keep the towel bar 26 in a predetermined orientation with respect to the post 21, the position of the towel rack 26 is positioned so that the towel bars 26*d* and 26*e* are in the position desired and then the fasteners 26*c* are tightened tight enough to prevent rotation with respect to the post 21, but the orientation of the towel rack 26 can be readjusted by reversing the assembly instructions recited above and then tightening the fasteners 26*c* again when the towel rack is in the position desired, for example to one of the positions of the towel racks 26 shown in FIG. 1 or 2.

FIG. 7 is an enlarged perspective view at the portion shown by the labeled FIG. 7 circled on FIG. 2, of a portion of the structure which connects the post 21 to the base 27 and of a structure 28 surrounding three sides 28*a*, 28*b* and 28*c* of such structure which further adds to the structural integrity of the attachment of the apparatus 10 to the spa 11. As shown in FIG. 2, collar 28*d* is disposed around the post 21 and is rigidly attached to the top of member 28. Collar 28*c* can have a set screw (not shown) threaded therethrough to engage the exterior of the post 21 if more rigidity is desired.

FIG. 7*a* shows how a bolt 27*b* extends through aligned openings in the post 21 and collar 27*a* to secure the post 21 to the base plate 27.

The apparatus shown in FIGS. 1-7*a* includes a spa 11 of a type having a bottomwith sidewalls 12 extending upwardly from the bottom to form an enclosure for holdingwater 16. A base member 27 is for being operatively disposed on a horizontal floor below and adjacent to the sidewalls 12 of the spa 11. A vertically disposed post member 21 isoperatively attached to the base member 27. A handrail 17 is operatively attached to anextreme top of the post member 21, the handrail 17 being transversely disposed with respect to the post member 21, such that the handrail 17 crosses a longitudinal axis and atleast two opposing points of a periphery of the post member 21, said points beingdisposed 180 degrees relative to one another about the longitudinal axis, and such that the handrail 17 extends beyond the periphery of the post member 17 at said at least twoopposing points of the periphery. A horizontally disposed tray 22 is pivotally attached tothe post 21. A towel bar 26 is operatively, pivotally attached to the post 21. A limiting collar 23 is disposed at least partially around the post member and operatively adjustablyaffixed thereto, the limiting collar 23 having an upper surface thereon that extends aroundat least a portion of the post, the limiting collar also having a projection extending 23d upwardly from the upper surface. One end of the tray 22 has a portion 22*a* thereof thatextends around the post 21 above the limiting collar 23 for permitting the tray 22 to pivotabout a substantially vertical axis. A downwardly extending stop 22*d* on said portion of the tray 22 that extends around the post 21 for limiting the degree of pivoting of the tray22 with respect to the post 21.

The bolt 27*b* is secured in place with nut 27*c*.

In installation, the assembly of the apparatus 10 is done as described above. Before the water 16 is placed in the spa 11, the spa 11 is lifted slightly and the base plate 27 is slid under it as shown in FIG. 1. Then the fasteners 25 of FIG. 5*a* are installed through openings 24*f* and into the sidewall 12 of the spa 11. This will securely hold the post 21 in the position shown in FIG. 1. The order of assembly is not, however, critical.

In use of the apparatus 10 of FIG. 1, someone using the spa would leave their shoes on the floor, deck or concrete slab 14 and then put their belongings such as a shirt, hat or towel on one or more of the rods 26*d* or 26*e* the towel rack 26. They could also put a beverage 123 of their choice on the tray 22. Then the user would use the steps 13 to enter the top of the spa 11. Usually people sit down in a spa so that only their heads and shoulders extend above the water 16. So such a person sitting in the spa could have access to anything on the tray 22, such as the beverage 123, or perhaps to a wrist watch (not shown) in case they need to leave the spa 11 at a certain time to go someplace else.

Accordingly, it will be appreciated that the apparatus 10 disclosed above does indeed overcome the aforementioned problems with the prior art. Obviously many modifications and variations of the present invention are possible in light of the above teachings. It is therefore to be understood that, within the scope of the appended claims, the invention may be practiced otherwise than as specifically described.

The invention claimed is:

1. An apparatus comprising:

a spa of a type having a bottom with sidewalls extending upwardly from the bottom to form an enclosure for holding water;

a base member for being operatively disposed on a horizontal floor below and adjacent to the sidewalls of the spa;

a vertically disposed post member operatively attached to the base member;

a handrail operatively attached to an extreme top of the post member, the handrail being transversely disposed with respect to the post member, such that the handrail crosses a longitudinal axis and at least two opposing points of a periphery of the post member, said points being disposed 180 degrees relative to one another about the longitudinal axis, and such that the handrail extends beyond the periphery of the post member at said at least two opposing points of the periphery;

a horizontally disposed tray pivotally attached to the post;

a towel bar operatively, pivotally attached to the post;

a limiting collar disposed at least partially around the post member and operatively adjustably affixed thereto, the limiting collar having an upper surface thereon that extends around at least a portion of the post, the limiting collar also having a projection extending upwardly from the upper surface;

one end of the tray having a portion thereof that extends around the post above the limiting collar for permitting the tray to pivot about a substantially vertical axis; and a downwardly extending stop on said portion of the tray that extends around the post for limiting the degree of pivoting of the tray with respect to the post.

2. The apparatus of claim 1 wherein the handrail has a downwardly extending tube which telescopes with respect to a top of the post, whereby the handrail can pivot with respect to the top of the post; and a stop structure associated with the top of the post and with the downwardly extending tube of the handrail for selectively preventing the handrail from pivoting or telescoping with respect to the post.

3. The apparatus of claim 1 wherein the tray is disposed over the top of the sidewalls and the stop includes means for limiting the movement of the tray between only positions on the spa side of the post.

4. The apparatus of claim 1 wherein the base member is disposed between the bottom of the spa and a floor for securely holding the bottom of the post from moving during the use of the apparatus.

5. The apparatus of claim 1 including means for adjusting the position of the towel bar with respect to the post up or down or pivotally about said longitudinal axis.

6. The apparatus of claim 5 wherein the towel bar includes a first and a second horizontally disposed rod extending radially outwardly from said longitudinal axis.

7. The apparatus of claim 1 including means for operatively attaching or detaching the base member to or from a bottom of the post.

8. The apparatus of claim 7 including a support member operatively attached to the base member and to the post for adding further stability to the connection between the base member and the post.

9. The apparatus of claim 8 wherein the support member extends around at least three sides of the post.

10. The apparatus of claim 9 wherein the support member is open on one side for accessing the means for operatively attaching or detaching the base member to or from a bottom of the post, and said one open side is disposed towards one of the sidewalls of the spa.

11. The apparatus of claim 10 wherein the support member is in abutment with said one of the sidewalls of the spa for lending additional support to hold the post in its vertically disposed position.

12. The apparatus of claim 1 wherein the tray is disposed above the sidewalls of the spa so that persons in the spa can easily place objects onto the tray.

13. The apparatus of claim 1 including a second towel bar operatively attached to the post below the first said towel bar.

14. The apparatus of claim 13 wherein the second towel bar includes another first and another second horizontally disposed rod extending radially outwardly from said longitudinal axis.

15. The apparatus of claim 1 including a bracket for operatively attaching the post member to the sidewalls of the spa.

16. The apparatus of claim 15 wherein the bracket is disposed around the post and has openings therein for receiving fasteners that are disposed therethrough and into one of the sidewalls of the spa.

* * * * *